US008046947B2

(12) United States Patent
Fu et al.

(10) Patent No.: US 8,046,947 B2
(45) Date of Patent: Nov. 1, 2011

(54) UNDERWATER GUN COMPRISING A PASSIVE FLUIDIC BARREL SEAL

(75) Inventors: Jyun-Horng Fu, Centreville, VA (US); Robert James Howard, Clifton, VA (US); Antonio Paulic, Arlington, VA (US); John W. Rapp, Manassas, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 744 days.

(21) Appl. No.: 12/165,079

(22) Filed: Jun. 30, 2008

(65) Prior Publication Data

US 2010/0281730 A1 Nov. 11, 2010

(51) Int. Cl.
*F41C 9/06* (2006.01)

(52) U.S. Cl. ..... 42/1.14; 89/5; 89/31; 114/316

(58) Field of Classification Search ..... 42/1.14; 89/5, 31, 1.809; 114/316
See application file for complete search history.

(56) References Cited

U.S. PATENT DOCUMENTS

| | | | | |
|---|---|---|---|---|
| 5,639,982 | A | 6/1997 | Cipolla | |
| 5,648,631 | A | 7/1997 | Kirschner et al. | |
| 5,687,501 | A | 11/1997 | Stace et al. | |
| 5,746,018 | A | 5/1998 | Kirschner et al. | |
| 5,966,858 | A | 10/1999 | Curtis et al. | |
| 6,305,263 | B1 * | 10/2001 | Wallin | 89/5 |
| 6,701,819 | B1 | 3/2004 | Williams et al. | |
| 7,237,353 | B1 | 7/2007 | Beauchamp et al. | |
| 7,681,352 | B2 * | 3/2010 | Fu et al. | 42/1.14 |
| 7,832,134 | B2 * | 11/2010 | Fu et al. | 42/1.14 |

* cited by examiner

*Primary Examiner* — J. Woodrow Eldred
(74) *Attorney, Agent, or Firm* — DeMont & Breyer, LLC

(57) ABSTRACT

An apparatus and method for sealing the barrel of an underwater gun between firings is disclosed. The apparatus clears the barrel and/or prevents water from entering the barrel based on pressure variations.

7 Claims, 4 Drawing Sheets

UNDERWATER GUN COMPRISING A PASSIVE FLUIDIC BARREL SEAL

CROSS REFERENCE TO RELATED APPLICATIONS

This case is related to the following U.S. patent applications: Ser. No. 12/165,060 (Underwater Gun Comprising a Valve-Type Barrel-Seal), Ser. No. 12/165,066 (Underwater Gun Comprising a Barrel Adapter including a Barrel Seal), 12/165,071 (Underwater Gun Comprising a Plate-Type Barrel Seal), and Ser. No. 12/165,090 (Underwater Gun Comprising a Turbine-Based Barrel Seal), all of which were filed on even date herewith and all of which are incorporated by reference herein.

FIELD OF THE INVENTION

The present invention relates to underwater guns.

BACKGROUND OF THE INVENTION

Underwater guns are useful as anti-mine and anti-torpedo devices. Recently, autonomous underwater vehicles (AUVs) have been fitted with underwater guns for torpedo defense and underwater "hunter-killer" CONOPs.

A gun, especially one with a high muzzle velocity, cannot be fired when water is in its barrel. If a firing where to incur in a water-filled barrel, a very high breach pressure would result as the ignited propellant charge forces (or tries to force) the water out of the barrel. The likely result would be material failure of the barrel.

The prior art is replete with approaches for waterproofing the barrel of an underwater gun, or for clearing water from its barrel before firing. U.S. Pat. No. 5,639,982 discloses a means for firing a fully automatic gun underwater using a blank barrel-clearance round. Blank barrel-clearance rounds are alternated with live rounds of ammunition. To begin the process, a blank barrel-clearance round is first detonated. This creates gas and steam within the chamber that forms a bubble at the muzzle end of the barrel, thereby displacing water from the chamber. A live round is then immediately fired. The process is repeated, whereby the subsequent detonation of a blank barrel-clearance round displaces any water that has re-entered the barrel subsequent to the firing of the live round.

U.S. Pat. No. 5,648,631 discloses a spooled tape seal for sealing the barrel of an underwater gun. The system includes a tap that covers the opening of the gun barrel and sprockets for advancing the tape across the opening. Hydrostatic pressure keeps the tape pressed to the end of the barrel to create an effective seal. When a bullet is fired, it perforates the tape. During this brief period of egress, the exhaust gases from combustion of the propellant charge keep water from entering the barrel. Almost immediately, a non-perforated portion of the tape is advanced by the sprockets to cover the barrel opening. External hydrostatic pressure re-seats the tape, thereby preventing water from entering the barrel.

U.S. Pat. No. 5,687,501 discloses a sealing plate for providing a watertight seal for a multi- or single-barreled underwater gun. The sealing plate provides one or more firing apertures in an otherwise solid surface. Between firings, the gun muzzle is sealed by a solid surface of the sealing plate. To fire a bullet, the sealing plate or muzzle rotates to align the gun muzzle with one of the firing apertures. This permits unimpeded egress. After the bullet fires, the plate or muzzle again rotates so that a solid portion of the sealing plate covers the muzzle.

These are but a few of the many patents pertaining to various aspects of underwater gun design in general, and to the water-in-the-barrel problem, in particular. Notwithstanding the many approaches to the problem, no truly satisfactory approach has been developed for keeping water out of the barrel of an underwater gun between and during operation.

SUMMARY OF THE INVENTION

The present invention provides an underwater gun having a barrel seal for preventing water from entering the barrel between the firing of rounds.

In the illustrative embodiment, the barrel is "sealed" via a fluid. In some embodiments the fluid is a liquid and in some other embodiments, the fluid is a gas or vapor. Furthermore, the seal is created passively. That is, by virtue of certain physical adaptation, the seal is created via movement of the underwater gun or the firing of a round from the gun.

In a first embodiment, the barrel is sealed using a liquid. In fact, the liquid is the surrounding water in which the underwater gun operates. The muzzle end of the barrel of the gun comprises a bulbous cap with an opening for the muzzle of the barrel. The cap includes a plurality of channels that lead from the interior of the barrel to the exterior of the barrel. The gun is assumed to be disposed on an AUV, such that it is at least periodically in motion.

As the gun moves through water, the water flows over the exterior of the cap at a velocity that is always greater than the velocity of water that is within the barrel, which is essentially zero. As a consequence, a region of relatively low pressure (i.e., lower than within the barrel) exists in the vicinity of the exterior-side openings to the channels in the cap. This velocity and pressure differential is increased by the bulbous shape of the cap, which tends to induce relatively higher-velocity streamlines near its surface. Water within the barrel is therefore drawn from the barrel due to this pressure differential; that is, via a Bernoulli effect.

In a second embodiment, the barrel is sealed using a gas, such as the combustion gases resulting from ignition of a round's propellant charge. In this embodiment, a chamber is attached to the muzzle of the barrel. When combustion gas is forced into the chamber, the pressure inside increases. When the forces that urge the air into the cavity dissipate, the higher-pressure gas in the chamber will flow out. Any water that was in the barrel flows out with the gas. This surge of combustion gas out of the chamber tends to over-compensate, due to the inertia of the gas in the neck. As a consequence, the pressure in the chamber falls to a level that is slightly less than the pressure outside of the chamber. This causes the gas and water to be drawn back into the chamber. This process repeats. The frequency of repetition, which can be controlled, is synchronized with the firing of rounds from the gun.

The phenomenon described above is referred to as Helmholtz resonance, which is essentially the phenomenon of gas resonance in a cavity. In this embodiment, the chamber and the barrel itself function as a Helmholtz resonator.

In a third embodiment, the barrel seal is a vapor. In this embodiment, a plurality of nozzles are disposed near the muzzle of the barrel. Each nozzle includes a convergent section and a divergent section. Water flows into each nozzle controlled via a valve. A quantity of a metal, such as aluminum, etc., is disposed on an inner surface of the convergent section of each nozzle. As water is introduced into the nozzle, the metal burns the water to generate water vapor. The water vapor is accelerated out the divergent section of each nozzle, thereby creating a plurality of vapor jets directly in front of the muzzle of the barrel. These jets prevent water from entering the barrel.

DETAILED DESCRIPTION

The terms appearing below are defined for use in this specification, including the appended claims, as follows:

- Axially-oriented (or axial orientation) refers to an orientation that aligns with the longitudinal axis of an element. This orientation is orthogonal to a radial orientation.
- Barrel is a narrow, hollow cylindrical portion of a firearm through which a bullet travels.
- Bore is the hollow portion of the barrel through which a bullet travels during its acceleration phase.
- Breech is an opening in the rear of a barrel of a gun where bullets can be loaded.
- Chamber is the portion of a barrel where a cartridge is placed just prior to being fired. This is a high pressure containment area which is very precisely aligned with the bore of the barrel.
- Fluidically coupled or fluidic communication means that liquid, gas, or vapor from a first region can flow to or otherwise cause an effect in a second region. For example, if two regions are fluidically coupled (or in fluidic communication), a pressure change in one of those regions might (but not necessarily will) result in a pressure change in the other of the regions.
- Muzzle is the end of the barrel where the bullet exits as it is being fired.
- Operatively coupled means that the operation of one device affects another device, wherein the devices need not be physical attached to one another. For example, a laser and a mirror are operatively coupled if a laser directs a beam of light to the mirror. An actuator and a valve are operatively coupled if the actuator actuates the valve. Operatively-coupled devices can be coupled through any medium (e.g., semiconductor, air, vacuum, water, copper, optical fiber, etc.) and involve any type of force. Consequently, operatively-coupled objects can be electrically-coupled, hydraulically-coupled, magnetically-coupled, mechanically-coupled, optically-coupled, pneumatically-coupled, thermally-coupled, etc.
- Radially-oriented (or radial orientation) refers to an orientation that is coincident with the radial direction of an element. See "axially-oriented."

The present invention pertains to guns that are intended for (1) use in an underwater environment and (2) firing rounds that include a chemical propellant. The underwater guns described herein will typically, although not necessarily, be fitted to AUVs. For clarity, gun 100 is typically depicted in the Figures as having a single round in the chamber or bore. It is to be understood, however, that gun 100 is typically a multi-shot weapon.

Figure 1:
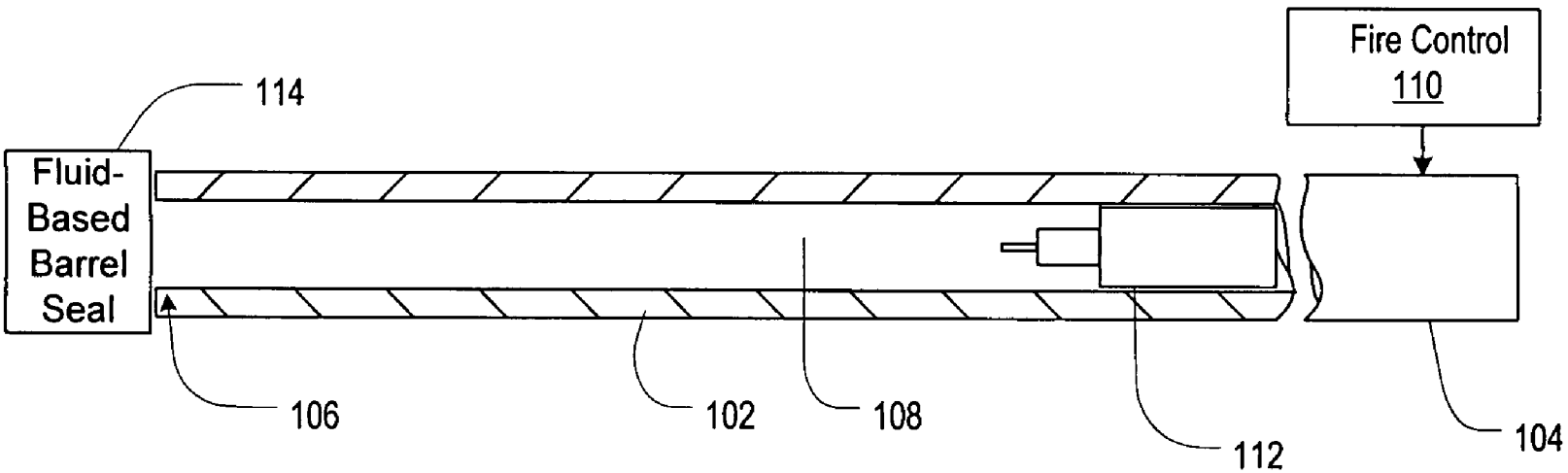
FIG. 1 depicts an underwater gun having a fluidic barrel seal in accordance with the illustrative embodiment of the present invention.

FIG. 1 depicts underwater gun 100 having a fluidic barrel seal in accordance with the illustrative embodiment of the present invention. Gun 100 includes barrel 102, ballistic chamber 104, bore 108, fire-control system 110, and fluidic barrel seal 114, interrelated as shown. A live round 112 is depicted in bore 108.

Barrel 102, ballistic chamber 104, and bore 108 are conventional features of most guns. Fire-control system 110 is basically a computer and ancillary elements that enable gun 100 to hit a target. The relative sophistication of any particular embodiment of fire-control system 110 is primarily a function of the intended application for gun 100. That is, a relatively more sophisticated fire-control system is required for a relatively more autonomous application (e.g., for use in conjunction with an AUV, etc.).

In a typical embodiment, fire-control system 110 interfaces with one or more sensors (e.g., sonar, radar, infra-red search and track, laser range-finders, water current, thermometers, etc.). The sensor input is used to develop a firing solution for a target. To the extent that gun 100 is located on an AUV, etc., fire-control system 110 advantageously takes into account movements of the AUV itself. And, when associated with an AUV, fire-control system 110 is operatively coupled to aiming and firing mechanisms.

The fire-control system is not particularly germane to an understanding of the invention and, furthermore, is well understood by those skilled in the art. As a consequence, fire-control system 110 will not be described in further detail.

This specification now proceeds with a description of several embodiments of a fluidic barrel seal for use in conjunction with underwater gun 100.

Figure 2:
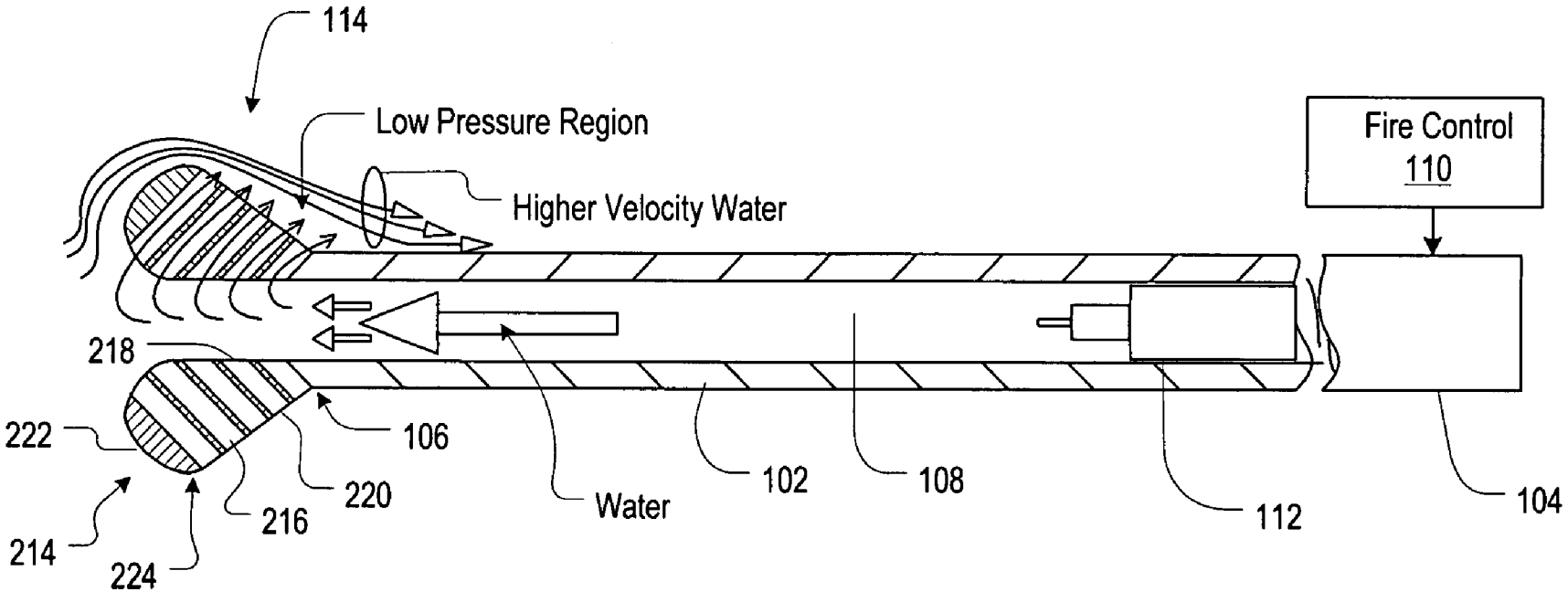
FIG. 2 depicts a first embodiment of the fluidic barrel seal of the underwater gun of FIG. 1.

Gun 100 of FIG. 2 includes barrel 102, ballistic chamber 104, bore 108, fire-control system 110, and muzzle cap 214, interrelated as shown. Live round 112 is depicted in bore 108.

Muzzle cap 214, which in this embodiment serves as fluidic barrel seal 114, has a bulbous shape and includes a plurality of channels 216. A first end 218 of channels 216 are in fluidic communication with bore 108 and a second end 220 of channels 216 are in fluidic communication with the ambient environment. Muzzle cap 214 is thickest at location 224. The thickness of cap 214 decreases linearly from location 224 until it meets and matches the wall thickness of barrel 102. Forward of location 224 (forward surface 222 of cap 214) has an arcuate shape.

As gun 100 moves through water, the bulbous-shape of muzzle cap 214 causes relatively higher-velocity streamlines adjacent to the surface of the cap. Water in bore 108 has effectively zero velocity. In accordance with Bernoulli's relation, there will, therefore, be a pressure differential between first end 218 and second end 220 of channels 216. In particular, there will be a relatively lower pressure associated with the higher-velocity region at the exterior of muzzle cap 214 and a relatively higher pressure associated with the lower-(zero) velocity region in bore 108. As a consequence, water that is within bore 108 is drawn from the barrel through channels 216 to the exterior of muzzle cap 214.

As will be appreciated by those skilled in the art, the design of muzzle cap 214 is dependent upon operating depth and speed. Generally, this approach to barrel sealing is more effective at relatively high operating velocities, such as about 45 knots speed, and at relatively shallow operating depths, such as less than about 45 feet depth. Those skilled in the art will be able to design and build a muzzle cap as a function of the intended operating conditions.

Figure 3:
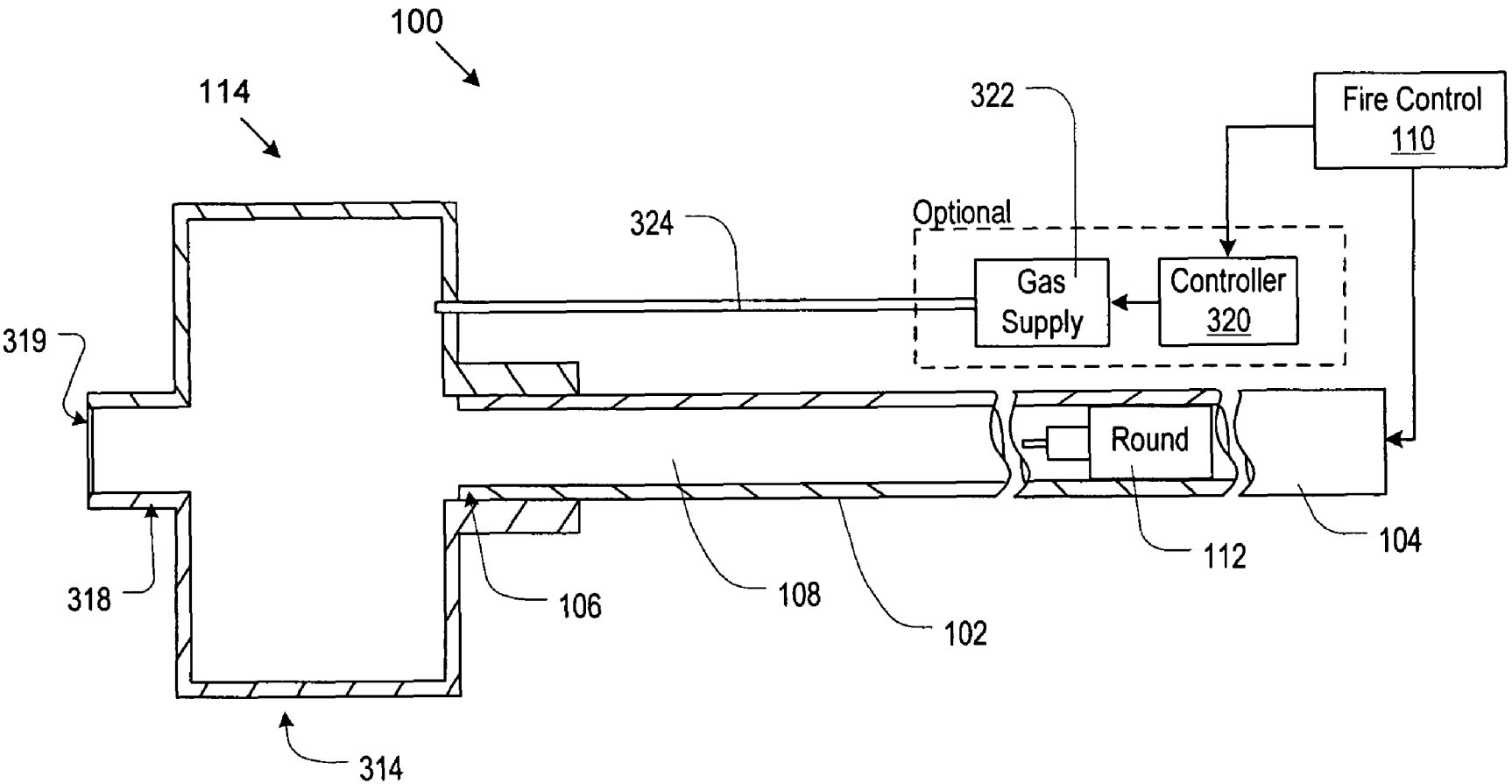
FIG. 3 depicts a second embodiment of the fluidic barrel seal of the underwater gun of FIG. 1.

Gun 100 of FIG. 3 includes barrel 102, ballistic chamber 104, bore 108, fire-control system 110, chamber 314 and neck 318, interrelated as shown. For this embodiment, the chamber and neck serve as fluidic barrel seal 114. Live round 112 is depicted in bore 108.

When round 112 is fired, the combustion gases that result from ignition of the round's propellant are forced into chamber 314. As a consequence, the pressure inside chamber 314 increases. When the forces that urge the gases into chamber 314 dissipate, the relatively higher-pressure gases in chamber 314 flow out. Water in neck 318, chamber 314, or bore 108 flows out with the gas (although a gas/water interface, in the form of a "meniscus," would exist in the neck).

This surge of combustion gas out of chamber 314 tends to "over-compensate," due to the inertia of the gas in neck 318. As a consequence, the pressure in chamber 314 falls to a level that is slightly less than the pressure outside of the chamber. This causes the gas and water to be drawn back into the chamber. This process repeats. The frequency of repetition, which can be controlled, is synchronized with the firing of rounds from the gun.

The phenomenon described above is referred to as Helmholtz resonance, which is essentially the phenomenon of gas resonance in a cavity. In this embodiment, the chamber and the barrel itself function as a Helmholtz resonator.

The resonant frequency, in Hz, of a Helmholtz resonator having a cylindrical or rectangular neck is given by the expression:

$$f_H = \frac{\upsilon}{2\pi}\sqrt{\frac{A}{V_0 L}} \quad [1]$$

Where:

A is the cross-sectional area of the neck;

$V_0$ is the static volume of the cavity;

L is the length of the neck;

ν is speed of sound in a gas:

$$\upsilon = \sqrt{\gamma\frac{P_0}{\rho}}$$

Where:

γ is the ratio of specific heats, which is usually 1.4 for air and diatomic gases;

$P_0$ is the static pressure in the cavity; and

P is the density of the gas.

The performance of this system can be altered by changing the dimensions of chamber 314 and/or neck 318. For example, increasing the volume of chamber 314 reduces the resonant frequency because more gas must move out of the chamber to relieve a given excess of pressure. Viewed from a different perspective, the volume of the chamber appears in the denominator of expression [1] because the spring constant of the gas in the chamber is inversely proportional to its volume.

The inertia of the air in neck 318 is proportional to the length of the neck. So, increasing the length of neck 318, for example, decreases the resonant frequency because there is greater overall resistance to the movement of gas in and out of the neck. The area of neck 318 is important for two reasons. Increasing the area of neck 318 increases the inertia of the gas proportionately, but also decreases the velocity at which the gases rush in and out.

In some embodiments, optional gas supply 322 and controller 320 are used to supply additional gas, via conduit 324, to chamber 314. This provides an additional parameter for altering the resonant frequency of the system.

Prior to first use, neck 318 is sealed with a rupture disk, etc., to prevent water entery. When the first round is fired, the rupture disk bursts, and then the resonator begins operating.

It is notable that the resonator will provide only a brief period of operation before the barrel fills with water. As a consequence, this approach can be used to fire only relatively few rounds—perhaps between about 3 to 10 rounds. For that reason, the AUV or other device that carries the underwater gun would be outfitted with a plurality of such guns. As soon as the barrel of one of the guns fills with water, it is taken off line and a second gun continues firing, as desired.

Figure 4:
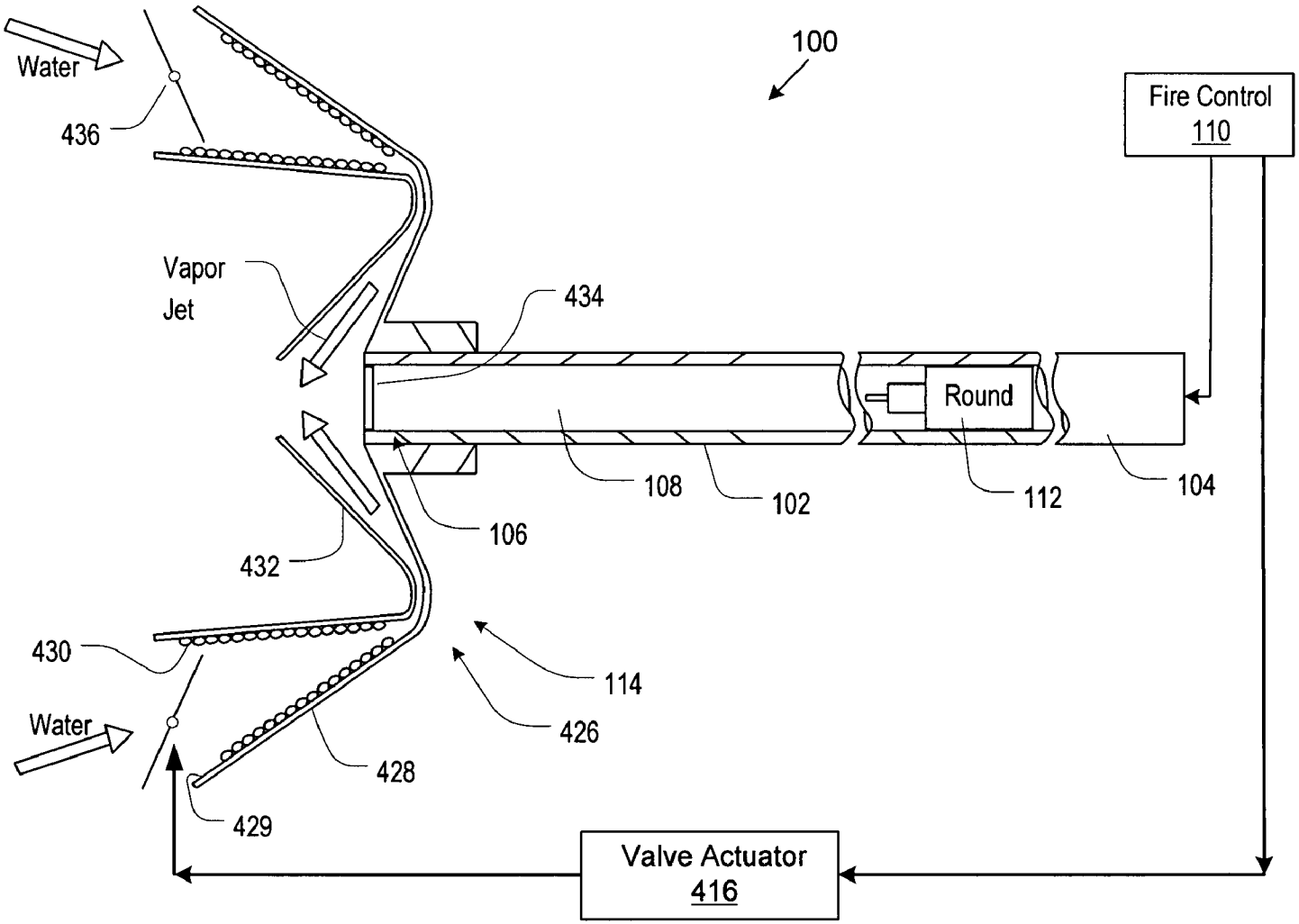
FIG. 4 depicts a third embodiment of the fluidic barrel seal of the underwater gun of FIG. 1.

Gun 100 of FIG. 4 includes barrel 102, ballistic chamber 104, bore 108, fire-control system 110, and nozzles 426, interrelated as shown. For this embodiment, nozzles 426 function as fluidic barrel seal 114. Live round 112 is depicted in bore 108.

In this embodiment, a plurality of nozzles 426 are disposed at muzzle end 106 of barrel 102. Although the cross-sectional view of FIG. 4 enables only two such nozzles to be clearly depicted, for most embodiments, gun 100 has at least three nozzles 426.

Each nozzle 426 includes convergent section 428 and divergent section 432. Water flows into each nozzle controlled via throttle valve 436. Surface 429 of convergent section 428 is coated with agent 430, typically a metal, which is capable of "burning" water or otherwise generating water vapor from liquid water. A partial list of agents suitable for this purpose includes aluminum, sodium, cesium, magnesium, potassium, lithium, rubidium, and alloys thereof. Due to the extreme reactivity of some of these agents, some technique should be used to control the vapor-generating reaction. For example, the reaction can be controlled by creating a situation in which the reaction is diffusion limited, such as by applying, such as a water-soluble film as described in WO 2001/074711, to agent 430.

During periods of non-use, rupture disk 434 seals barrel 102. When fire-control system 110 receives an indication to fire, it sends a signal to valve actuation system 116. The valve actuation system opens throttle valves 426 (e.g., butterfly valves, etc.) to admit water to convergent section 428 of the nozzle. The water reacts with agent 430 to generate water vapor. The water vapor is accelerated out of divergent section 432 of each nozzle 426, thereby creating a plurality of vapor jets-directly in front of the muzzle of the barrel. The pressure of the jets is greater than the ambient water pressure at the prevailing depth of gun 100. The jets are, therefore, capable of preventing water from entering the barrel.

While the water jets are operating, round 112 is fired. The combustion gases that are generated upon ignition of the round's charge cause rupture disk 434 to rupture, thereby permitting passage of round 112.

During repetitive firing, the continuous generation of combustion gases, in conjunction with the water jets, prevents water from entering barrel 102.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. An underwater gun, comprising:

a barrel, wherein the barrel has a muzzle and an axially-oriented first bore; and a chamber and a chamber neck that are suitably sized and arranged to function as a Helmholz resonator, wherein:

(a) the chamber and the muzzle are coupled to one another at a first end of the chamber;

(b) the chamber and the chamber neck are coupled to one another at a second end of the chamber; and (c) the chamber neck is axially aligned with the first bore of the muzzle and of sufficient diameter to permit a round to transit the chamber and chamber neck.

2. The underwater gun of claim 1 further comprising a source of pressurized gas, wherein the source of pressurized gas is fluidically coupled to the chamber.

3. The underwater gun of claim 1 further comprising a seal that seals the chamber neck prior to first use.

4. The underwater gun of claim 3 wherein the seal is a rupture disk.

5. The underwater gun of claim 1 wherein the chamber is provided with a volume that is selected to provide a desired resonance frequency to provide a desired rate of fire.

6. The underwater gun of claim 1 wherein the chamber neck is provided with a length that is selected to provide a desired resonance frequency to provide a desired rate of fire.

7. The underwater gun of claim 1 wherein the chamber neck is provided with a cross-sectional area that is selected to provide a desired resonance frequency to provide a desired rate of fire.

* * * * *